US007344459B2

(12) United States Patent
Bykowsky

(10) Patent No.: US 7,344,459 B2
(45) Date of Patent: Mar. 18, 2008

(54) MOUND MENDER

(76) Inventor: John Bykowsky, 184 Bellair Rd., Ridgewood, NJ (US) 07450

( * ) Notice: Subject to any disclaimer, the term of this patent is extended or adjusted under 35 U.S.C. 154(b) by 154 days.

(21) Appl. No.: 11/063,044

(22) Filed: Feb. 22, 2005

(65) Prior Publication Data

US 2006/0100042 A1 May 11, 2006

Related U.S. Application Data

(60) Provisional application No. 60/626,812, filed on Nov. 10, 2004.

(51) Int. Cl.
*A63B 71/00* (2006.01)

(52) U.S. Cl. ..... 473/497

(58) Field of Classification Search ..... 473/497, 473/499

See application file for complete search history.

(56) References Cited

U.S. PATENT DOCUMENTS 2,156,469 A * 5/1939 Boltz ..... 473/497
2,189,428 A * 2/1940 Love ..... 473/497
3,837,646 A * 9/1974 Goeders ..... 473/497
4,306,718 A * 12/1981 Goeders ..... 473/497
4,561,653 A * 12/1985 Wright ..... 473/497
4,666,155 A * 5/1987 Stille ..... 473/497
4,749,223 A * 6/1988 Goeders ..... 473/497
5,058,889 A * 10/1991 Burton ..... 473/452
5,213,323 A * 5/1993 Novinsky ..... 473/451
5,467,977 A * 11/1995 Beck ..... 473/497
5,707,305 A * 1/1998 Goeders et al. ..... 473/497
5,919,103 A * 7/1999 Bartoli ..... 473/497
6,500,078 B1 * 12/2002 Williams et al. ..... 473/452

* cited by examiner

*Primary Examiner*—Raleigh W. Chiu
(74) *Attorney, Agent, or Firm*—Peter G. Thurlow

(57) ABSTRACT

An apparatus for use on a pitching mound includes a first platform being covered with an elastic material, a second platform being covered with artificial turf like material and the first platform being slightly raised with respect to the second platform.

2 Claims, 3 Drawing Sheets

MOUND MENDER

PRIORITY

The application claims priority under 35 USC 119 based on provisional application 60/626,812 filed on Nov. 10, 2004.

FIELD OF THE INVENTION

The present invention relates to pitching apparatus, and more particularly to the apparatus associated with the pitching rubber.

BACKGROUND

Pitching a baseball is an art form. However, the mechanics of pitching have a basis in science. All pitchers must employ a pitching rubber on a pitching mound. These pitching mounds are a traditional part of the game of baseball and softball, and these pitching rubbers are mounted at generally the center portion of the pitching mound. Typically, the pitching rubbers are made of hard rubber, and the pitcher must be in contact with the pitching rubber while throwing the baseball or softball. Consequently, these pitching rubbers are subject to wear and must be replaced. The pitching rubber may be securely attached to an embedded stationary support for example a wood block embedded securely in the ground so that the pitching rubber cannot move, providing a secure platform for the pitcher. Additionally, these pitching rubbers are rectangular in shape; the adult pitching rubber is 6 inches wide, 24 inches long and as much as 4 inches thick. If the pitching rubber is properly installed, it should protrude only about a quarter an inch above the mound itself. All baseball pitchers have the same basic pitching technique. This technique has the pitcher balanced over the post leg as the front leg is raised at the beginning of the motion. Softball pitchers do not necessarily raise their front leg but still require balance over their back leg. To successfully implement this technique, the area in front of the pitcher should be free of depressions. A depression in the ground will cause the pitcher to be unable to maintain his/hers balance over at the post leg at the start of the motion. If the pitcher is off-balance at the start of this motion, the pitcher may be even more off-balance as he/her proceeds down the drive line towards the plate. The pitcher loses accuracy and velocity.

However, while a pitching mound is being used, these depressions are created by the pitcher and after a short period of time, these depressions become sufficiently large to create a problem for the pitchers.

One solution to this problem is a step down rubber. A step down rubber is a standard 24×6 ins pitching rubber with a 4×24 ins platform positioned in front of it, towards home plate, that is 2 to 2½ ins below the surface of the rubber. A step down rubber is buried in the pitching mound so that the lower front platform provides support for the dirt in front of the pitching rubber. This platform is not intended to be stepped on. While this prevents depressions from becoming more than 2 to 2½ ins deep, it does not necessarily prevent depressions.

In the major leagues, these depressions are being constantly repaired by the grounds crew, and consequently, these depressions are not a great problem for the pitchers.

With the remaining baseball diamonds, this problem may exist because a grounds crew may not exist. Without a grounds crew, these depressions become large and are a significant problem for pitchers. These depressions in time can be a chronic problem.

SUMMARY

The present invention provides an apparatus that eliminates the depression in front of the pitching rubber for baseball or softball applications. The present invention provides a platform that may be covered with artificial turf like material so that the pitcher's post leg does not come in contact with the ground. As a consequence, the pitcher does not create a depression in front of the pitching rubber which causes loss of balance.

DETAILED DESCRIPTION

Figure 1:
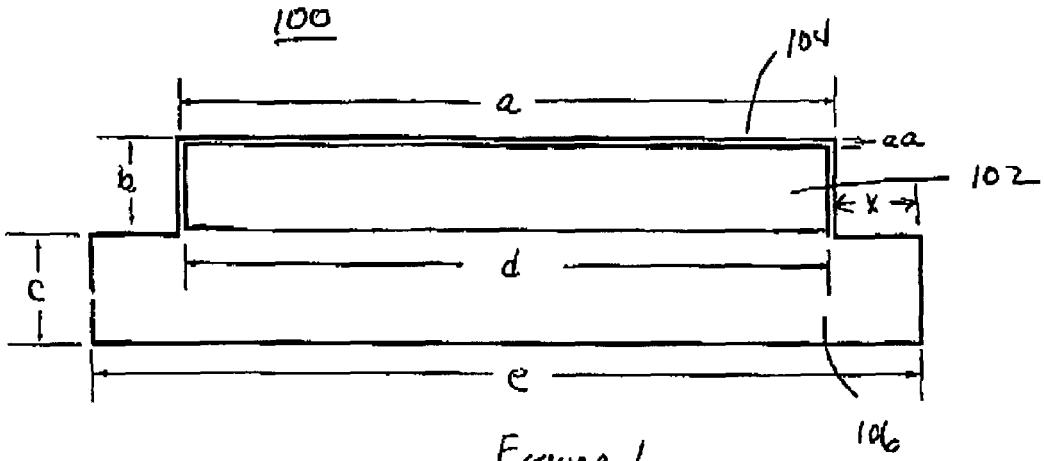
FIG. 1 illustrates a top view of the base.

FIG. 1 illustrates a top view of base 100 for baseball and softball applications. The base 100 includes a rubber cap platform 102 and an artificial turf platform 106. For purposes of this application, the front is the direction towards the home plate and the back is the direction towards second base. The rubber cap platform 102 has a substantially rectangular cross section with the longitudinal dimension of 'a' where 'a' is approximately 24 ins and a traverse dimension of 'b' where 'b' is approximately 6 ins and includes a shoulder 104 along the longitudinal back of the rubber cap platform 102 and along the side traverse of the rubber cap platform 102. The rubber cap platform 102 has an inside longitudinal dimension of 'd' where 'd' is approximately 23⅛ ins. The shoulder 104 has a width of 'aa' where 'aa' is approximately ⅜ ins. The rubber cap platform 102 could be constructed without the shoulder 104. The artificial turf platform 106 has a substantially rectangular cross section with a longitudinal dimension of 'e' where 'e' is approximately 32 ins and traverse dimension of 'c' where 'c' is approximately 7½ and is to allow the pitcher to support a leg and to prevent a hole from being created. The artificial turf platform 106 extends beyond the rubber cap platform in the longitudinal direction by a dimension 'x' where 'x' is approximately 4 ins and is sufficiently wide to prevent the pitcher from overstepping the artificial turf platform 106 during his/her pitch and creating a depression. The artificial turf platform 106 shows square corners; however, round corners could be used with equally good results. The rubber cap platform 102 is sized to be approximately the same size as a pitching rubber whether professional or amateur. The size of the rubber cap platform 102, the artificial turf platform 106 and the associated apparatus can be suitably scaled down for youth size.

Shoulders 104 are sufficiently wide to allow a flush surface when used in conjunction with the rubber cap 302. The shoulder 104 is approximately positioned to contact the edge of the rubber cap 302 as the top of the rubber cap platform 102 contacts the rubber cap 302.

Figure 2:
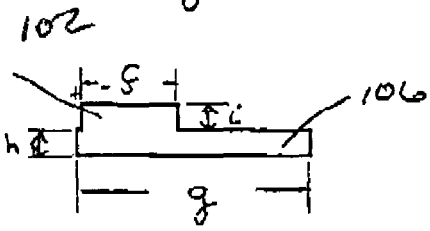
FIG. 2 illustrates a side view of the base.

FIG. 2 illustrates a side view of the rubber cap platform 102 and artificial turf platform 106. The rubber cap platform 102 extends above the artificial turf platform 106 by dimension 'i' where 'i' is approximately 2 ins to provide a sufficiently high platform for the rubber cap 302 to be mounted and withstand removal and to provide a higher platform then the artificial turf platform 106 to simulate the height of the pitching rubber above the pitching mound. The rubber cap platform 102 has a depth of dimension 'f' where 'f' is approximately 5⅛ and is covered by the rubber cap 302. The rubber cap platform 102 and artificial turf platform 106 may be formed as a single platform of rubber, steel, wood, fiberglass or any other suitable material. The depth of the base 100 is dimension 'g' where 'g' is approximately 13½ ins. The height to the shoulder is dimension 'h' where 'h' is approximately 1¾ ins.

Figure 3:
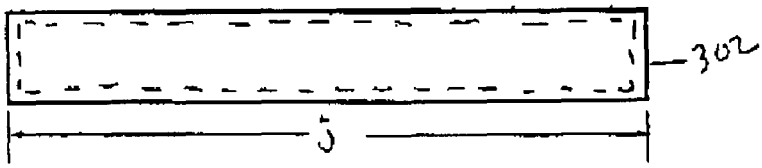
FIG. 3 illustrates a top view of the replaceable rubber cap.
Figure 5:
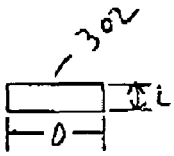
FIG. 5 illustrates a side view of the replaceable rubber cap.
Figure 4:
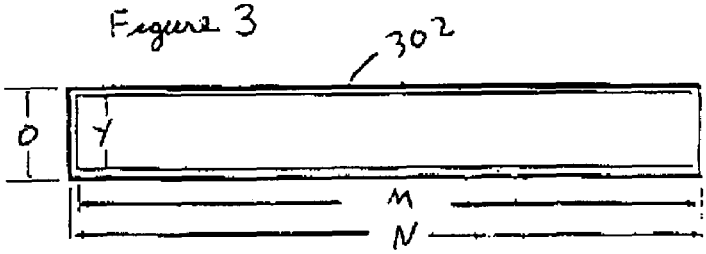
FIG. 4 illustrates a bottom view of the replaceable rubber cap.

FIG. 3 illustrates a top view of rubber cap 302 with a longitudinal dimension of 'j' where 'j' is approximately 24 ins. The rubber cap 302 is dimensioned on the inside to be removably secure to cover the rubber cap platform 102 by sliding over rubber cap platform 102 and being secured by nails, screws or pins or any other suitable fastener. The rubber cap 302 can be removed and replaced when worn out or damaged. A rubber covering (with sheets of rubber) could be used in conjunction with the rubber cap platform 102 as another alternative. The rubber cap 302 is preferably made of elastic material, typically hard rubber or other suitable material. FIG. 4 illustrates a bottom view of the rubber cab 302 having a inside longitudinal dimension of 'm' where 'm' is approximately 23¼ ins and an inside traverse dimension of 'y' where 'y' is approximately 5¼, and FIG. 5 illustrates a side view of the rubber cap 302. The height of the rubber cap 302 which is dimension 'l' were 'l' is approximately 2⅜ ins. of the rubber cap 302 will not affect the operation. However, the height of the rubber cap 302 should be sufficient so that the rubber cap 302 can not be easily removed by normal pitching use.

Figure 6:
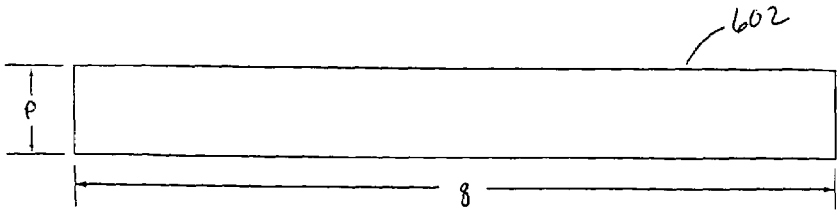
FIG. 6 illustrates a top view of the replaceable platform.

FIG. 6 illustrates a replaceable platform 602 which is shown as having a substantially rectangular cross section. The longitudinal dimension is 'q' where 'q' is approximately 32 ins or larger, or alternatively it could be the same size as rubber cap, namely 24 ins (or anywhere in between) and a traverse dimension of 'p' where 'p' is approximately 7½ ins. The replaceable platform 602 may be approximately coextensive in length and width with the artificial turf platform 106. The replaceable platform 602 may be covered with artificial turf like material such as artificial turf or any other suitable material that is professional grade. The replaceable platform 602 could be constructed from rubber, wood, metal including steel, and fiberglass or any other suitable material.

Figure 7:
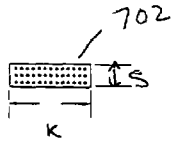
FIG. 7 illustrates a mending plate.

FIG. 7 illustrates a mending plate 702 including a plurality of holes to accept screws or any suitable fastener.

Figure 8:
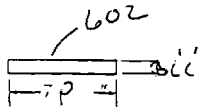
FIG. 8 illustrates a side view of the replaceable platform.

FIG. 8 shows a side view of replaceable platform 602 with a height of dimension of 'ii' where 'ii' is approximately 1¾ ins.

Figure 9:
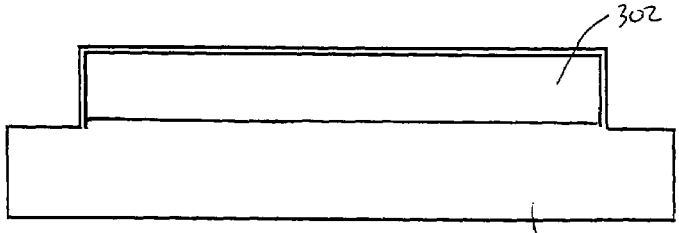
FIG. 9 illustrates a top view of the replaceable rubber cap and platform with artificial turf attached to the base.

FIG. 9 illustrates a top view of the rubber cap 302 adjacent to the platform 602 with artificial turf like material such as artificial turf or any other suitable material.

Figure 10:
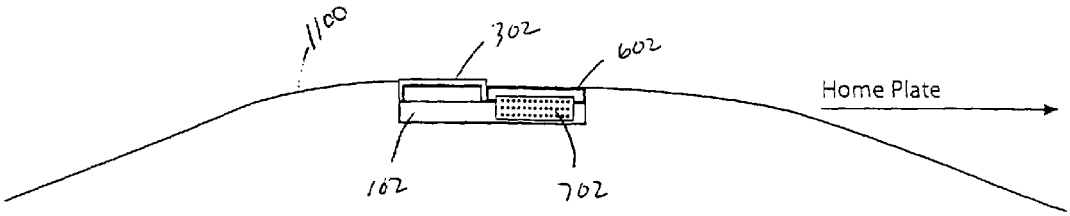
FIG. 10 illustrates a side view of the platform attached to the base with the mending plate and the replaceable rubber cap imbedded in a pitchers mound facing towards home plate.

FIG. 10 illustrates a side view of an assembled base 100 including the rubber cap platform 102 with rubber cap 302 which could be removable and replaceable and replaceable platform 602 on a pitchers mound 1100. The replaceable platform 602 is positioned on and connected to artificial turf platform 106 by mending plate 702 and is positioned toward home plate. The use of the mending plate 702 to connect the replaceable platform 602 and the artificial turf platform 106 allows the replaceable platform 602 to be connected and disconnected easily. This replacement of the artificial turf platform 106 facilities the replacement of the artificial turf like material such as artificial turf when the turf wears out. Other ways to connect the replaceable platform 602 and the artificial turf platform 106 are within the scope of the present invention. The artificial turf platform 106 is at substantially ground level of the pitchers mound 1100, and the rubber cap 302 is slightly, for example ¼ to ¾ ins, above the ground level of the pitchers mound 1100.

Figures 11, 12, 13, 14, 15, 16, 17, 18, 19, 20, 21:
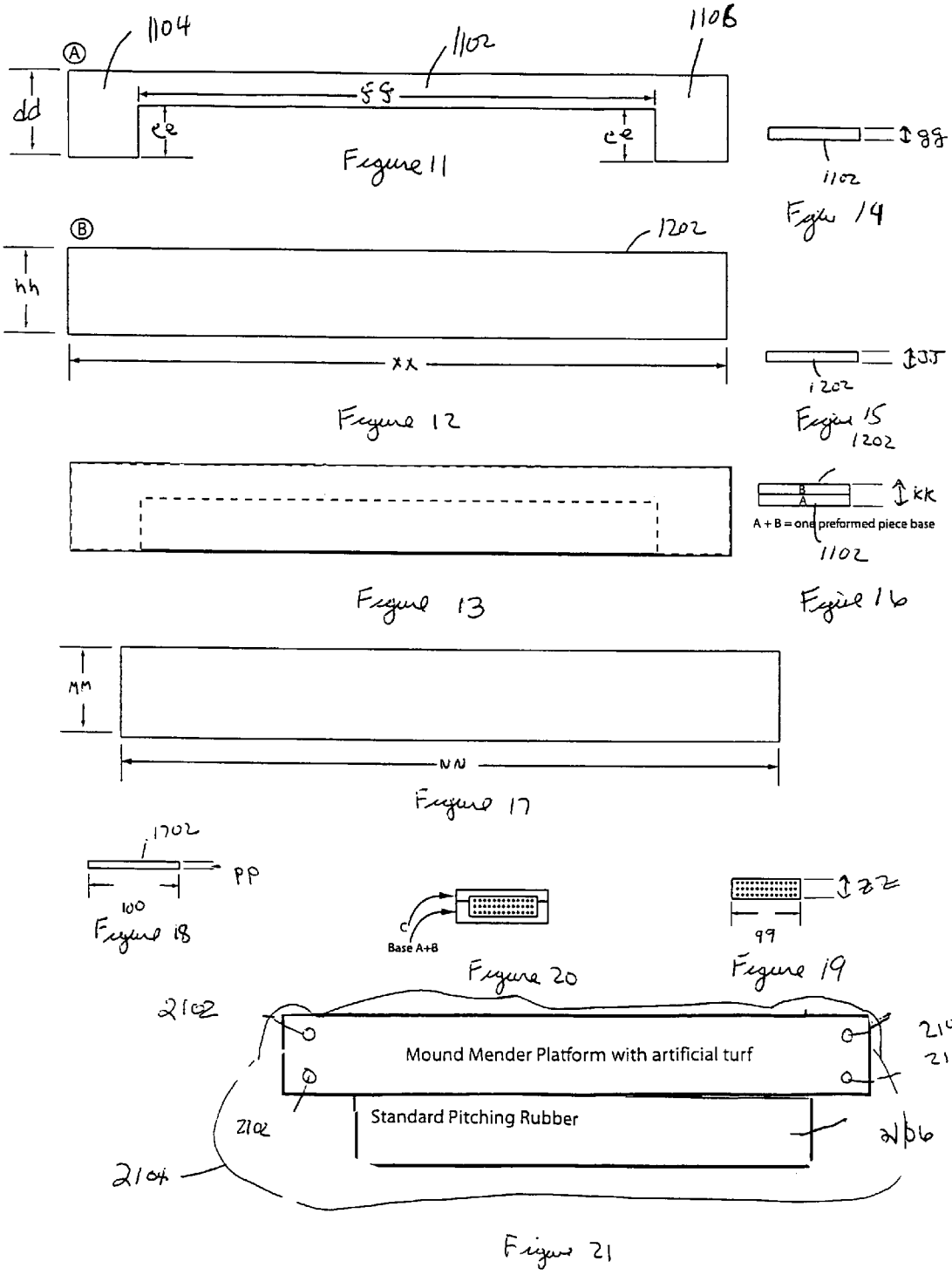
FIG. 11 illustrates a top view of a first part.
FIG. 12 illustrates a top view of a second part.
FIG. 13 illustrates a top view of the first part and second part combined.
FIG. 14 illustrates a side view of the first part.
FIG. 15 illustrates a side view of the second part.
FIG. 16 illustrates a side view of the first part and the second part combined.
FIG. 17 illustrates a top view of the replaceable platform.
FIG. 18 illustrates a side view of the replaceable platform.
FIG. 19 illustrates a mending plate.
FIG. 20 illustrates a side view of the assembled first part and second part with the replaceable platform with artificial turf like material such as artificial turf.
FIG. 21 illustrates a top view of the replaceable platform with a pitching rubber.

FIG. 11 shows a first part 1102 which is substantially U-shaped and includes arms 1104, 1106. The first part 1102 has a longitudinal dimension between the arms of 'ff' where 'ff' is approximately 25 ins and has a traverse dimension of 'dd' where 'dd' is approximately 7½ ins. The arms have a inside traverse dimension of 'ee' where 'ee' is approximately 5 ins. The space between arms 1104 1106 forms an opening or cut out to accept a step down rubber. The arms 1104 1106 form the cut out to accommodate the lower front platform of the step down rubber. It could be placed in front of a standard pitching rubber that does not have a step down platform. FIG. 14 shows a side view of the first part 1102. The thickness of the first part is 'gg' where 'gg' is approximately 1 ins.

FIG. 12 shows a second part 1202 which has a substantially rectangular cross section and is substantially coextensive in length and width with the first part 1102. The second part 1202 has a traverse dimension of 'hh' where 'hh' is approximately 7½ ins and a longitudinal dimension of 'xx' where 'xx' is approximately 32 ins. The first part 1102 and the second part 1202 could be formed from wood, metal including steel, fiberglass or high strength plastic or any suitable material. FIG. 15 shows a side view of the second part 1202. The thickness of the second part 1202 is 'jj' where 'jj' is approximately ¾ ins.

FIG. 13 shows a top view of the second part 1202 with a portion of the step down rubber being shown in phantom line.

FIG. 16 shows the first part 1102 attached to and under the second part 1202 with a depth dimension of 'kk' where is approximately 1¾ ins.

FIG. 17 shows a replaceable platform 1702 which is to serve as a platform for the pitcher. The replaceable platform 1702 has is a substantially rectangular cross section with a traverse dimension of 'mm' where 'mm' is approximately 7½ ins and a longitudinal dimension of 'nn' where 'nn' is approximately 32 ins. The replaceable platform 1702 could be made from wood, metal including steel, fiberglass and plastic or any other suitable material. A side view of the replaceable platform 1702 is shown in FIG. 18 with a depth dimension 'pp' where 'pp' is approximately 1 ins and 'oo' which is approximately 7½ ins. The replaceable platform 1702 is substantially coextensive in length and width with the first part 1102 and the second part 1202. the replaceable platform 1702 may be covered with artificial turf like material such as artificial turf or any other suitable material.

FIG. 21 shows a top view of the pitching rubber 2106 with the replaceable platform 1702.

FIG. 19 shows an additional mending plate 1902 where 'qq' is approximately 5 in and 'zz' is approximately 2 ins and which is used to connect the first part 1102 and the second part 1202 to the replaceable platform 1702.

FIG. 20 illustrates the mending plate 1902 connecting the replaceable platform 1702 two the first part 1102 and second part 1202.

Referring to FIGS. 17 and 21, the replaceable platform 1702 could be used in conjunction with the pitching rubber 2106 by placing the replaceable platform 1703 adjacent to the pitching rubber 2106. The replaceable platform 1702 could be used with spikes 2102 to hold the replaceable platform 1702 in position with the pitching rubber 2106. The spikes 2102 could be positioned at each corner or at the bottom of the replaceable platform 1702.

One of ordinary skill in the art would recognize that the dimensions described above could be changed or varied without violating the spirit of the invention. Additionally, while specific materials have been described for the various aspects of the invention, generally the material used could be any suitable material.

The invention claimed is:

1. An apparatus for use on a pitching mound, comprising:

a first part adapted to accept a pitching rubber;

a second part being connected to said first part;

a replaceable platform being mounted on said second part and being covered with artificial turf, wherein said first part includes a first and a second arm to accept a step down rubber.

2. An apparatus to be placed within a pitching mound as in claim 1 wherein said first arm and said second arm are arranged so that said first part is U-shaped.

* * * * *